US011046497B2

(12) United States Patent
Nawaby et al.

(10) Patent No.: US 11,046,497 B2
(45) Date of Patent: Jun. 29, 2021

(54) CRIMPED CUSHIONED ENVELOPES AND METHOD OF FORMING THE SAME

(71) Applicant: Sealed Air Corporation (US), Charlotte, NC (US)

(72) Inventors: Arghavan Victoria Nawaby, Southlake, TX (US); Victoria G. Watlington, Charlotte, NC (US); Marshall E. Hewitt, Charlotte, NC (US)

(73) Assignee: Sealed Air Corporation (US), Charlotte, NC (US)

( * ) Notice: Subject to any disclaimer, the term of this patent is extended or adjusted under 35 U.S.C. 154(b) by 0 days.

(21) Appl. No.: 16/624,333

(22) PCT Filed: Jun. 18, 2018

(86) PCT No.: PCT/US2018/037977

§ 371 (c)(1),
(2) Date: Dec. 19, 2019

(87) PCT Pub. No.: WO2018/236697

PCT Pub. Date: Dec. 27, 2018

(65) Prior Publication Data

US 2020/0148444 A1 May 14, 2020

Related U.S. Application Data

(60) Provisional application No. 62/523,842, filed on Jun. 23, 2017.

(51) Int. Cl.
*B65D 81/03* (2006.01)
*B31B 70/14* (2017.01)
(Continued)

(52) U.S. Cl.
CPC ..... *B65D 81/03* (2013.01); *B31B 70/146* (2017.08); *B31B 70/262* (2017.08); *B31B 70/62* (2017.08);
(Continued)

(58) Field of Classification Search
CPC ..... B65D 81/03; B65D 27/14; B31B 70/262; B31B 70/643; B31B 70/146; B31B 70/62;
(Continued)

(56) References Cited

U.S. PATENT DOCUMENTS 2,357,339 A 9/1944 Mathieu
2,612,738 A 10/1952 Salfisberg
(Continued)

FOREIGN PATENT DOCUMENTS

EP 0172142 A2 2/1986
GB 2080765 A * 2/1982 ..... B42D 5/025
(Continued)

OTHER PUBLICATIONS

Written Opinion of the International searching authority in PCT/US2018/037977 dated Dec. 27, 2018.

*Primary Examiner* — Hemant Desai
*Assistant Examiner* — Jacob A Smith
(74) *Attorney, Agent, or Firm* — Jon M. Isaacson

(57) ABSTRACT

A cushioned envelope is formed from a laminated material that includes a cushioning web and a shell web. The outer side of the cushioning web is laminated to the inner side of the shell web. A crimping adhesive is applied to first and second transverse seams of the inner side of the cushioning web. The laminated web material is crimped so that each of the first and second transverse seams on the inner side of the cushioning web is folded in on itself. The folded laminated web material is crimped at the first transverse seam and at the second transverse seam. The crimped laminated web
(Continued)

material is cut at a location in the first transverse seam and at a location in the second transverse seam.

19 Claims, 11 Drawing Sheets

(51) Int. Cl.

| | |
|---|---|
| ***B31B 70/26*** | (2017.01) |
| ***B31B 70/62*** | (2017.01) |
| ***B31B 70/64*** | (2017.01) |
| ***B65D 27/14*** | (2006.01) |
| *B31B 170/20* | (2017.01) |
| *B31B 170/30* | (2017.01) |
| *B31B 155/00* | (2017.01) |
| *B31B 160/10* | (2017.01) |

(52) U.S. Cl.
CPC ..... *B31B 70/645* (2017.08); *B31B 70/649* (2017.08); *B65D 27/14* (2013.01); *B31B 2155/0014* (2017.08); *B31B 2160/10* (2017.08); *B31B 2170/20* (2017.08); *B31B 2170/30* (2017.08)

(58) Field of Classification Search
CPC ..... B31B 2170/20; B31B 2170/30; B31B 2155/0014
USPC ..... 493/243; 229/48, 53
See application file for complete search history.

(56) References Cited

U.S. PATENT DOCUMENTS 4,011,798 A * 3/1977 Bambara ..... B29C 65/18 493/240
4,095,695 A 6/1978 Steidinger
4,226,902 A * 10/1980 Webb ..... A47G 33/08 428/16
4,614,076 A 9/1986 Rathemacher
5,952,025 A 9/1999 Yannuzzi
6,423,166 B1 * 7/2002 Simhaee ..... B29C 53/16 156/156
6,908,422 B2 * 6/2005 Ichikawa ..... B65D 33/2558 493/186
6,974,406 B2 * 12/2005 Antonacci ..... B65D 29/04 493/186
7,559,186 B2 7/2009 Smith
8,465,404 B2 * 6/2013 Hadley ..... B65D 81/3858 493/218
2003/0234282 A1 * 12/2003 Stemmle ..... B65D 75/20 229/68.1
2004/0000581 A1 * 1/2004 Brandolini ..... B32B 27/36 229/68.1
2005/0100251 A1 * 5/2005 Havens ..... B32B 5/18 383/107
2006/0113360 A1 * 6/2006 Bartlett ..... B32B 3/12 229/68.1
2007/0059477 A1 * 3/2007 Perelman ..... A45C 3/001 428/58
2010/0054635 A1 * 3/2010 Wintring ..... B31F 1/10 383/35
2010/0278461 A1 * 11/2010 Veiseh ..... B65D 81/03 383/107
2014/0260094 A1 * 9/2014 Wehrmann ..... B65B 55/00 53/403
2014/0270584 A1 * 9/2014 Exner ..... B31B 50/81 383/61.1
2014/0364291 A1 * 12/2014 Ferrazzin ..... A24D 3/0254 493/4

FOREIGN PATENT DOCUMENTS

GB 2320909 A 7/1998
WO 2016004239 A1 1/2016

* cited by examiner

CRIMPED CUSHIONED ENVELOPES AND METHOD OF FORMING THE SAME

BACKGROUND

The present disclosure is in the technical field of forming cushioned envelopes. More particularly, the present disclosure is directed to forming cushioned envelopes by crimping areas of a laminated web material to form side seams of the cushioned envelopes.

A wide variety of objects, including fragile items, are transported in various types of mailing envelopes. In some cases, these envelopes have cushioning to provide some level of protection for the objects transported therein. The outer walls of cushioned envelopes are typically formed from protective materials, such as Kraft paper, cardstock, polyethylene-coated paper, other paper-based materials, polyethylene film, or other resilient materials. The walls of cushioned envelopes are lined with cushioning materials, such as air cellular material (e.g., BUBBLE WRAP™ air cellular material sold by Sealed Air Corporation), foam sheets, or any other cushioning material. The walls are typically adhered to the cushioning material when forming the cushioned envelopes.

There are a number of competing goals with the production of cushioned envelopes. It is desirable for the cushioned envelope to have sufficient strength to withstand the rigors of transportation. At the same time, it is desirable to keep the cost of the cushioned envelope as low as possible. In addition, it is desirable to be able to produce cushioned envelopes at a high rate (e.g., more than 60-100 envelopes per minute), and it can be difficult to produce high-strength, low-cost cushioned envelopes at such a high rate.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one embodiment a method of forming a cushioned envelope includes feeding a laminated web material comprising a cushioning web a shell web. Each of the cushioning web and the shell web includes an inner side and an outer side and the outer side of the cushioning web is laminated to the inner side of the shell web. The method further includes applying a crimping adhesive to a first transverse seam of the inner side of the cushioning web and to a second transverse seam of the inner side of the cushioning web and folding the laminated web material so that the first transverse seam on the inner side of the cushioning web is folded in on itself and the second transverse seam on the inner side of the cushioning web is folded in on itself. The method further includes crimping the laminated web material at the first transverse seam and at the second transverse seam after folding the laminated web material and cutting the laminated web material at a location in the first transverse seam and at a location in the second transverse seam after crimping the laminated web material.

In one example, the method further includes forming the laminated web material and the forming includes applying a laminating adhesive to at least one of the inner side of the shell web or the outer side of the cushioning web and pressing together the shell web and the cushioning web. In another example, the cushioning web includes a sheet of inflated cells. In another example, the method further includes inflating the sheet of inflated cells before forming the laminated web material. In another example, the crimping adhesive and the laminating adhesive have different formulations.

In another example, crimping the laminated web material includes rotating crimping rollers that comprise crimping extensions. In another example, the crimping rollers are arranged so that the crimping extensions are in an interference fit when each of the crimping extensions extends toward another other crimping roller. In another example, rotating the crimping rollers includes controlling a rotational speed of the crimping rollers so that a linear speed of ends of the crimping extensions is substantially similar to a linear speed of the laminated web material. In another example, at least one of the ends of the crimping extensions is convex.

In another example, applying the crimping adhesive to the first transverse seam comprises applying an amount of the crimping adhesive in a range from about 1.18 oz/yd$^2$ to about 3.54 oz/yd$^2$. In another example, folding the laminated web material comprises forming an off-center fold in the laminated web material, and the off-center fold defines a short side of the laminated web material and a long side of the laminated web material. In another example, the long side of the laminated web material comprises an adhesive strip. In another example, the short side extends a first distance away from the off-center fold, wherein the adhesive strip is located on the long side at a location that is a second distance away from the off-center fold, and first distance is less than the second distance.

In another example, the shell web comprises a paper-based material, and wherein the outer side of the shell web is uncoated. In another example, the shell web includes a polymer-based film. In another example, each of the first transverse seam and the second transverse seam has a seam strength that is greater than or equal to about 3.5 pounds per inch of seam. In another example, the method is performed repeatedly to cause formation of the cushioned envelope at a rate of at least 700 cushioned envelopes per minute. In another example, the cushioning web comprises an air cellular material having a series of transverse rows of inflatable cells, and the method further includes deflating at least one of the transverse rows of inflatable cells before applying the crimping adhesive, where the crimping adhesive is applied to the deflated at least one of the transverse rows of inflatable cells. In another example, the deflating includes peeling back a first layer of the air cellular material to expose a second layer of the air cellular material, and wherein the crimping adhesive is applied to the second layer of the deflated at least one of the transverse rows of inflatable cells.

In another embodiment, a cushioned envelope includes a laminated web material, first and second transverse seams, and a crimping adhesive. The laminated web material includes a cushioning web and a shell web, each of the cushioning web and the shell web includes an inner side and an outer side, and the outer side of the cushioning web is laminated to the inner side of the shell web. The first and second transverse seams are on the inner side of the cushioning web. The crimping adhesive is applied to the first and second transverse seams. The laminated web material is folded so that the first transverse seam on the inner side of the cushioning web is folded in on itself and the second transverse seam on the inner side of the cushioning web is folded in on itself. The folded laminated web material is crimped at a location in the first transverse seam and at a location in the second transverse seam so that the crimped locations in the first and second transverse seams form sides of the cushioned envelope.

In one example, the cushioning web includes a sheet of inflated cells. In another example, a laminating adhesive applied to at least one of the inner side of the shell web or the outer side of the cushioning web adheres the shell web to the cushioning web. In another example, the crimping adhesive and the laminating adhesive have different formulations. In another example, each of the crimping adhesive and the laminating adhesive has a number average molecular weight between about 500 and about 1400. In another example, each of the crimping adhesive and the laminating adhesive has a molecular weight in a range between about 30,000 and about 60,000. In another example, each of the crimping adhesive and the laminating adhesive has a polydispersity index in a range between about 25 to about 70. In another example, an amount of the crimping adhesive applied to the first and second transverse seams is in a range from about 1.18 oz/yd$^2$ to about 3.54 oz/yd$^2$.

In another example, the laminated web material is folded at an off-center fold in the laminated web material, and wherein the off-center fold defines a short side of the laminated web material and a long side of the laminated web material. In another example, the long side comprises an adhesive strip. In another example, the short side extends a first distance away from the off-center fold, wherein the adhesive strip is located on the long side at a location that is a second distance away from the off-center fold, and wherein first distance is less than the second distance. In another example, the shell web comprises a paper-based material, and wherein the outer side of the shell web is uncoated. In another example, each of the first transverse seam and the second transverse seam has a seam strength that is greater than or equal to about 4.5 pounds per inch of seam.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

Figure 1A:
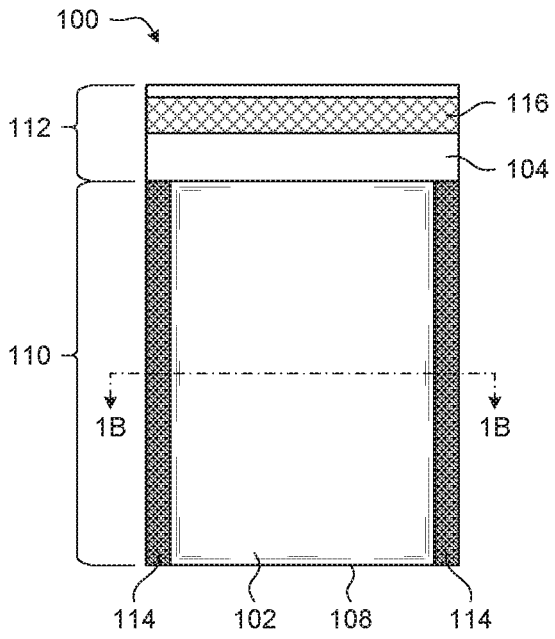
FIGS. 1A to 1C depict front, top cross-sectional, and partial detail views, respectively, of an embodiment of a cushioned envelope that exhibits clam-shelling along its side.
Figure 1B:
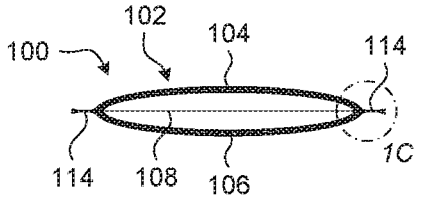
Figure 1C:
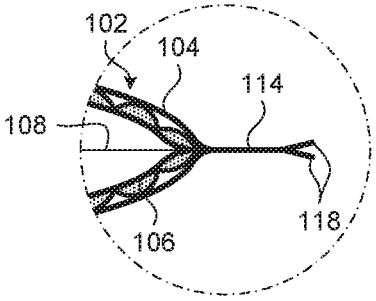

The present disclosure describes embodiments of cushioned mailers with sides formed by crimping. As noted above, it is desirable for cushioned mailers to have high strength and low cost, while being able to be produced at a high rate. Existing systems and methods of producing cushioned envelopes do not meet all of these goals. One example of some of the deficiencies of existing systems and methods of producing cushioned envelopes is shown in FIGS. 1A to 1C. More particularly, FIGS. 1A to 1C depict front, top cross-sectional, and partial detail views, respectively, of an embodiment of a cushioned envelope 100 that exhibits clam-shelling along its side.

The cushioned envelope 100 is formed from a laminated web material 102. The laminated web material 102 includes a shell web 104 laminated to a cushioning web 106. In particular, a portion of an inner side of the shell web 104 is laminated to an outer side of the cushioning web 106. In some embodiments, the shell web 104 includes one or more paper-based materials, such as Kraft paper, cardstock, or any other paper-based material. In some embodiments, the cushioning web 106 includes one or more of a web of inflatable cells, a web of sheet foam (e.g., closed-cell foam or open-cell foam), or any other web of cushioning material.

The laminated web material 102 is folded about an off-center fold 108. The off-center fold 108 in the laminated web material 102 defines a short side of the laminated web material 102 and a long side of the laminated web material 102. In the embodiment shown in FIG. 1A, the short side is in front of the long side. The laminated web material 102 forms a pocket 110 and a flap 112. The pocket 110 is formed from the short side of the laminated web material 102 and a portion of the long side of the laminated web material 102. The flap 112 is formed from a portion of the long side of the laminated web material 102 that extends beyond the pocket 110. In the depicted embodiment, the cushioning web 106 is laminated to the portion of the shell web 104 that is located in the pocket and the portion of the shell web 104 in the flap 112 is not laminated to the cushioning web 106. In the depicted embodiment, the flap 112 includes an adhesive strip 116. The adhesive strip 116 can be used to close the cushioned envelope 100 by folding the flap 112 down and adhering the adhesive strip 116 to the pocket 110.

The pocket 110 of the cushioned envelope 100 includes crushed sides 114. In some cases, the crushed sides 114 are formed by jaws. The jaws form the crushed sides 114 by holding the sides of the pocket 110 under pressure. In some examples, the jaws are heated to cause melting of a coating (e.g., a polymer-based coating) on the exterior of the shell web 104. The solidification of the coating after the crushed sides 114 are formed can aid in maintaining the shape of the crushed sides 114. As can be seen in FIG. 1B, the cushioning web 106 is crushed between the cushioning web 106 in the area of the crushed sides 114 so that the cushioning web 106 lines the interior of the shell web 104 in the pocket 110.

One issue with cushioned envelopes is clam-shelling along the sides of cushioned envelopes. Clam-shelling refers to the separation of ends on sides of cushioning envelopes. In some cases, clam-shelling can appear to an observer to be the beginning of a complete separation of the sides. An embodiment of clam-shelling is depicted on the cushioning envelope 100 in FIGS. 1B and 1C. More specifically, the crushed sides 114 are separated at ends 118 of the shell web 104. In some cases the separation of the crushed sides 114 is a separation of one or both of the shell web 104 or the cushioning web 106 in the crushed sides 114. The separation of the ends 118 may appear to an observer that the crushed sides 114 are separating or otherwise lack structural integrity. In some cases, the crushed sides 114 do not lack structural integrity, even though the ends 118 of the shell web 104 are somewhat separated and may cause an observer to think otherwise. In some cases, clam-shelling in the cushioned envelope 100 is a result the process of forming the cushioned envelope 100.

A previous attempt to address the problem of clam-shelling included a combination of a polymer-based coating on the inner side of the shell web 104 and the use of heated jaws to cut and seal the ends 118 of the shell web 104 and to form the crushed sides 114. The laminated web material 102 is formed into an elongated web that is fed by the jaws. As the laminated web material 102 is fed, the jaws are periodically brought together. The jaws have a cutting element to cut the ends 118 of the shell web 104 from the laminated web material 102. The jaws also have a heating element to heat the shell web 104. As the jaws are brought together, the jaws cut the ends 118 of the shell web 104 and heat the coating on the inner side of the shell web 104. The heated coating from both sides of the inner side of the shell web 104 flows together and then, after the jaws are removed, the coating solidifies to form a single bar of the coating that seals the ends 118. This seal of the coating deters any separation of the ends 118.

There are some drawbacks to the heated jaws approach. In one example, the use of the heated claims requires the shell web 104 to be coated, such as with a polymer-based coating. The coating makes the shell web 104 more expensive than the uncoated version of the shell web 104. In another example, the use of the heated jaws slows down the process of making the cushioned envelopes. In order to sufficiently heat the coating, the heated jaws must remain in contact with the laminated web material 102 for a period of time. This typically requires the feeding of the laminated web material 102 to be halted during the time that the heated jaws are in contact the laminated web material 102. This results in the laminated web material 102 being repeatedly moved a short distance and halted for a time, before starting the process again to move the laminated web material 102 another short distance and halt the laminated web material 102 to make another cut and seal. The repeated halting of the laminated web material 102 limits the overall speed with which the cushioned envelopes can be created.

What is needed is a process of creating cushioned envelopes that do not exhibit clam-shelling, while not requiring an external coating and not requiring regular stopping of laminated web material during formation of the cushioned envelopes. Disclosed herein are systems and methods of forming cushioned mailers by crimping the sides of the cushioned envelope. In some embodiments disclosed herein, the sides of a cushioned envelope are crimped by crimping rollers before the sides of the cushioned envelope are cut. The embodiments described herein of crimping cushioned envelope sides can be used to produce high-strength cushioned envelopes that can cost less and can be produced at higher rates than the cushioned mailers that are produced using heated jaws to cut and seal their sides.

Figure 2:
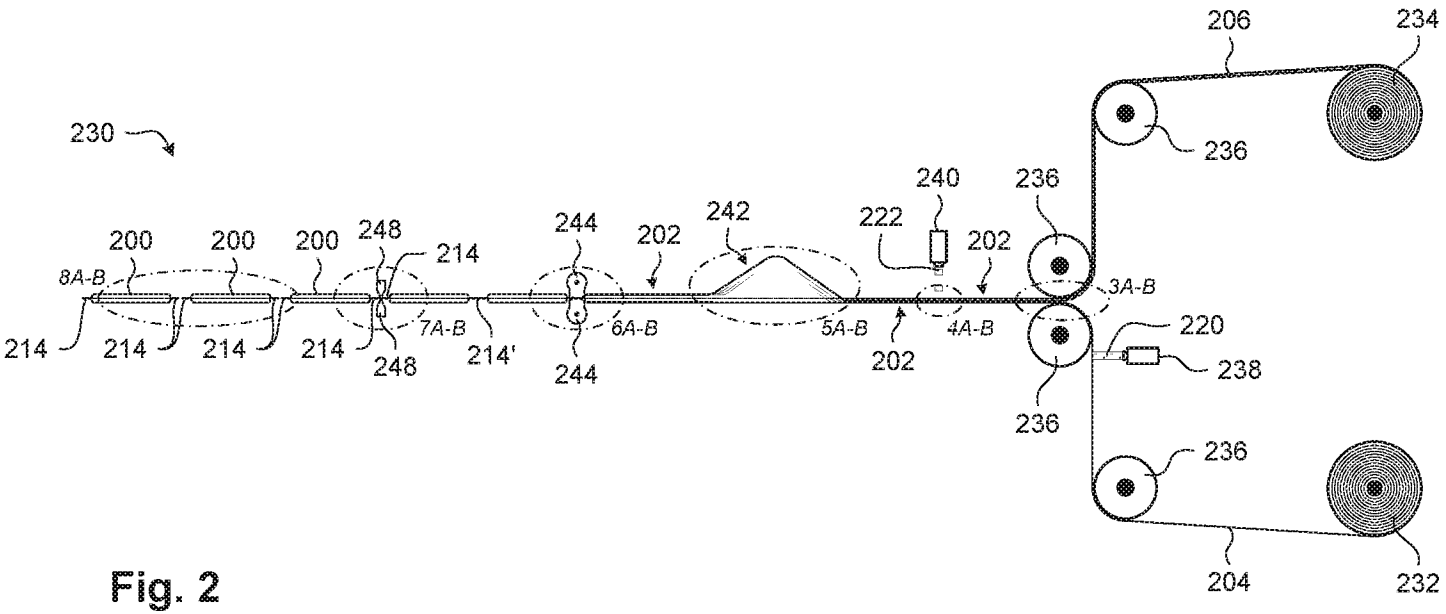
FIG. 2 depicts embodiments of a system and a method of forming cushioned envelopes, in accordance with the embodiments disclosed herein.

Depicted in FIG. 2 are embodiments of a system 230 and a method of forming cushioned envelopes 200. The perspective of FIG. 2 is from a bottom view of the cushioned envelopes 200. The system 230 includes a supply 232 of a shell web 204. Systems for supplying webs of film, paper, and other materials are known in art and may include unwind mechanisms and other features. In some embodiments, the shell web 204 includes a paper-based material, such as Kraft paper, cardstock, or any other paper-based material. In some embodiments, the shell web 204 is a polymer-based film, such as a polythene film. The system 230 also includes a supply 234 of a cushioning web 206. In some embodiments, the cushioning web 206 includes one or more of a web of inflatable cells, a web of sheet foam (e.g., closed-cell foam or open-cell foam), or any other web of cushioning material. In some embodiments, the supply 234 includes a film of inflatable cells and the system 230 further includes an inflation and seal device that inflates the cells in the film and seals the cells in the inflated state. The system 230 also includes feeding rollers 236 configured to support and direct the shell web 204 and the cushioning web 206. In some embodiments, the feeding rollers 236 include driving rollers that are powered to feed the shell web 204 and the cushioning web 206, passive rollers that are moved by the passage of the shell web 204 and the cushioning web 206, or some combination of driving rollers and passive rollers. In other embodiments, the system 230 includes additional feeding rollers downstream of the feeding rollers 236 in the depiction shown in FIG. 2.

The system 230 includes an adhesive applicator 238 configured to apply laminating adhesive 220 that is usable to laminate the outer side of the cushioning web 206 to the inner side of the shell web 204. In the depicted embodiment, the adhesive applicator 238 is positioned to apply the laminating adhesive 220 onto the inner side of the shell web 204. In other embodiments, the adhesive applicator 238 can be positioned to apply the laminating adhesive 220 onto the outer side of the cushioning web 206. In some embodiments, the laminating adhesive 220 includes one or more of REYNOLDS 810-C adhesive, REXTAC 2330 adhesive, HENKELTDM 4700 adhesive, HP FULLER NW1137 ZP adhesive, BOSTIC H9689 adhesive, or IFS-6-85-11 adhesive. In some emblements, the laminating adhesive 220 has a number average molecular weight (Mn) between about 500 and about 1400. The number average molecular weight (Mn) is a statistical average of molecular weights of an entire population of the polymer chains in a given sample. In some embodiments, the laminating adhesive 220 has a molecular weight (Mw) in a range between about 30,000 and about 60,000. The molecular weight of a polymer (Mw) takes into account the molecular weight of a chain in the samples, where larger or bigger chains generally correspond to higher average Mw. In some embodiments, the laminating adhesive 220 has a polydispersity index (Mw/Mn) in a range between about 25 to about 70. The polydispersity is a ratio of Mw/Mn and it represents the degree of branching in polymers, where higher polydispersity index generally corresponds with greater branching and degree of entanglement in the polymer. In some embodiments, the laminating adhesive 220 is either an amorphous structure or a semi-crystalline material having a melt point in a range between about 28° C. to about 92° C.

In some embodiments, the adhesive applicator 238 is configured to apply the laminating adhesive 220 by one or more of spraying, thermal drop-on-demand depositing, piezoelectric drop-on-demand depositing, electrostatic depositing, or any other form of applying the laminating adhesive 220. In some embodiments, the laminating adhesive 220 is applied at a temperature in a range from about 300° F. to about 450° F. In some embodiments, the amount of the laminating adhesive 220 applied to the seams is in a range from about 0.059 oz/yd$^2$ (2 g/m$^2$) to about 0.44 oz/yd$^2$ (15 g/m$^2$).

After the laminating adhesive 220 is applied, the outer side of the cushioning web 206 is laminated to the inner side of the shell web 204. The lamination of the shell web 204 to the cushioning web 206 is further depicted in front and bottom views shown in FIGS. 3A and 3B. In the depicted embodiment, the outer side of the cushioning web 206 is laminated to the inner side of the shell web 204 to form a laminated web material 202. In the depicted embodiment, the cushioning web 206 is a web of inflated hemispherical cells and the outer side of the cushioning web 206 that is laminated to the inner side of the shell web 204 is the rounded side of the inflated hemispherical cells. In other embodiments, the cushioning web 206 could be any other shape of inflated cellular cushioning, foam sheeting, or any other type of cushioning material.

Figure 3A:
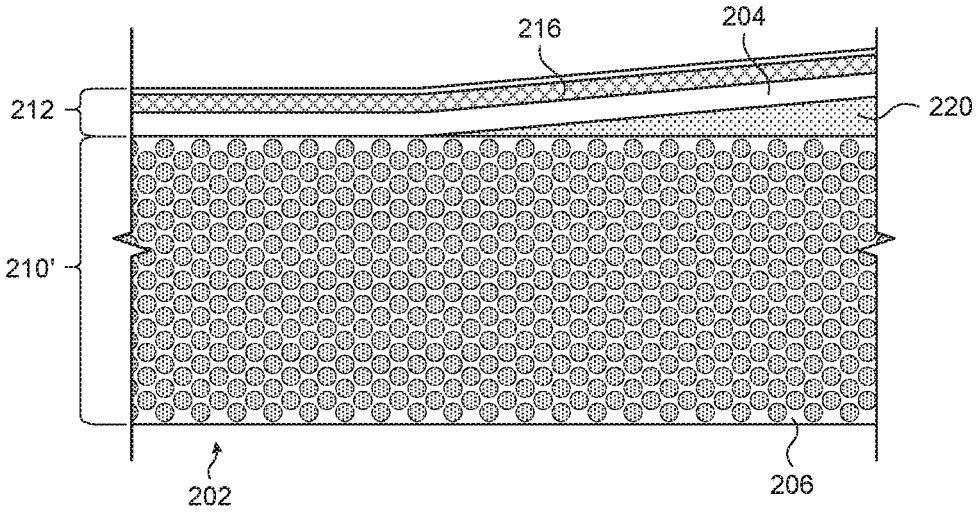
FIGS. 3A and 3B depict front and bottom views of an embodiment of lamination of a shell web to a cushioning web that are shown in FIG. 2, in accordance with the embodiments disclosed herein.
Figure 3B:
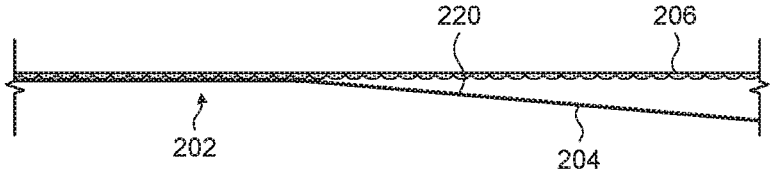

As can be seen in FIG. 3A, the laminated web material 202 includes a laminated portion 210' and a flap 212. The laminated portion 210' includes the portion of the shell web 204 that is laminated to the cushioning web 206. The flap 212 includes the portion of the shell web 204 that extends beyond the cushioning web 206. In the depicted embodiment, the laminating adhesive 220 has been applied to the shell web 204 in the area that is laminated to the cushioning web 206 and becomes the laminated portion 210'. In some embodiments, the adhesive applicator 238 applies the laminating adhesive 220 continuously onto the shell web 204, such as in the continuous application of the laminating adhesive 220 on the shell web 204 in the embodiment depicted in FIG. 3A. In other embodiments, the adhesive applicator 238 applies the laminating adhesive 220 intermittently to the shell web 204. In some embodiments, a pressure is applied to the shell web 204 and the cushioning web 206 as they are laminated together, such as a pressure exerted by two of the feeding rollers 236 as the shell web 204 and the cushioning web 206 pass between the two feeding rollers 236.

Referring back to FIG. 2, the laminated web material 202 is fed to an adhesive applicator 240 that is configured to apply a crimping adhesive 222 to the laminated web material 202 on the inner side of the cushioning web 206. In some embodiments, the crimping adhesive 222 includes one or more of REYNOLDS 810-C adhesive, REXTAC 2330 adhesive, HENKELTDM 4700 adhesive, HP FULLER NW1137 ZP adhesive, BOSTIC H9689 adhesive, or IFS-6-85-11 adhesive. In some embodiments, the crimping adhesive 222 has a number average molecular weight (Mn) between about 500 and about 1400. In some embodiments, the crimping adhesive 222 has a molecular weight (Mw) in a range between about 30,000 and about 60,000. In some embodiments, the crimping adhesive 222 has a polydispersity index (Mw/Mn) in a range between about 25 to about 70. In some embodiments, the crimping adhesive 222 is either an amorphous structure or a semi-crystalline material having a melt point in a range between about 28° C. to about 92° C.

In some embodiments, the adhesive applicator 240 is configured to apply the crimping adhesive 222 by one or more of spraying, thermal drop-on-demand depositing, piezoelectric drop-on-demand depositing, electrostatic depositing, or any other form of applying the crimping adhesive 222. In some embodiments, the crimping adhesive 222 is applied at a temperature in a range from about 300° F. to about 450° F. In some embodiments, the crimping adhesive 222 has the formulation as the laminating adhesive 220. For example, the crimping adhesive 222 and the laminating adhesive 220 may both be REXTAC 2330 adhesive. In some embodiments, the crimping adhesive 222 has a different formulation than the laminating adhesive 220. For example, the crimping adhesive 222 may be REYNOLDS 810-C adhesive and the laminating adhesive 220 may be HP FULLER NW1137 ZP adhesive.

Figure 4A:
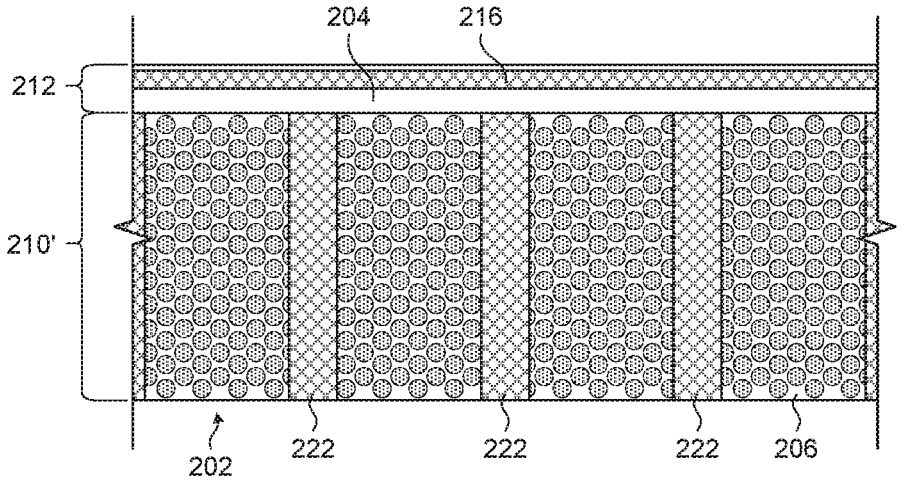
FIGS. 4A and 4B depict front and bottom views of an embodiment of intermittent application of a crimping adhesive to the inner side of the cushioning web that is shown in FIG. 2, in accordance with the embodiments disclosed herein.
Figure 4B:
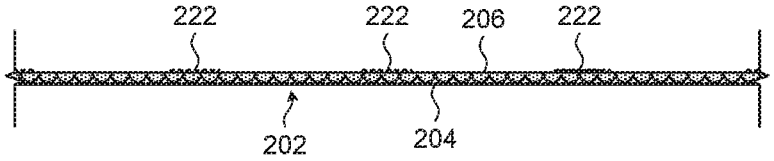

The adhesive applicator 240 is configured to apply the crimping adhesive 222 intermittently to the inner side of the cushioning web 206. The intermittent application of the crimping adhesive 222 is further depicted in front and bottom views shown in FIGS. 4A and 4B. As can be seen in FIG. 4A, the crimping adhesive 222 is applied to transverse seams on the inner side of the crimping adhesive 222. The transverse seams with the crimping adhesive 222 are spaced apart from each other in a longitudinal direction of the laminated web material 202. In the depicted embodiment, the crimping adhesive 222 applied to the laminated web material 202 does not cover any portion of the shell web 204. In some embodiments, the amount of the crimping adhesive 222 applied to the seams is in a range from about 1.18 oz/yd$^2$ (40 g/m$^2$) to about 3.54 oz/yd$^2$ (120 g/m$^2$). In some embodiments, the seams covered by the crimping adhesive 222 are about 6.5 inches in length in the transverse direction and about 1 inch in the longitudinal direction.

In some embodiments, where the cushioning web 206 is an air cellular material, a portion of the air cellular material may be deflated prior to applying the crimping adhesive 222. In particular, the portion of the air cellular material that is deflated prior to applying the crimping adhesive may include the area where the crimping adhesive 222 is later applied. In one example, the cushioning web 206 may include a series of transverse rows of inflatable cells, where each transverse row includes inflatable cells that are in fluid communication with each other. In this example, at least one transverse row may be deflated before the crimping adhesive 222 is applied to the deflated at least one transverse row. In some embodiments, deflating a portion of the air cellular material includes peeling back one layer of the air cellular material from the deflated portion such that the other layer of the air cellular material is exposed. In some cases, the exposed layer is adhered to the shell web 204 via the laminating adhesive 220 and then the crimping adhesive 222 is applied to the exposed layer. In this case, anything adhered to the exposed layer of the air cellular material via the crimping adhesive 222 may have a more secure feel because the exposed layer of the air cellular material is also directly adhered to the shell web 204.

Referring back to FIG. 2, the laminated web material 202 is fed so that a folding process 242 is performed to fold the laminated web material 202. The folding process 242 of the laminated web material 202 is further depicted in front and bottom views shown in FIGS. 5A and 5B. The folding process 242 causes the laminated web material 202 to be folded about a fold 208 with the inner side of the cushioning web 206 folded in on itself. More particularly, the folding process 242 causes each of the seams of the crimping adhesive 222 to be folded in on itself. After the folding process 242 is completed, the transverse seams of the crimping adhesive 222 are no longer visible, but the locations 224 of the transverse seams are depicted by dashed lines in the figures.

Figure 5A:
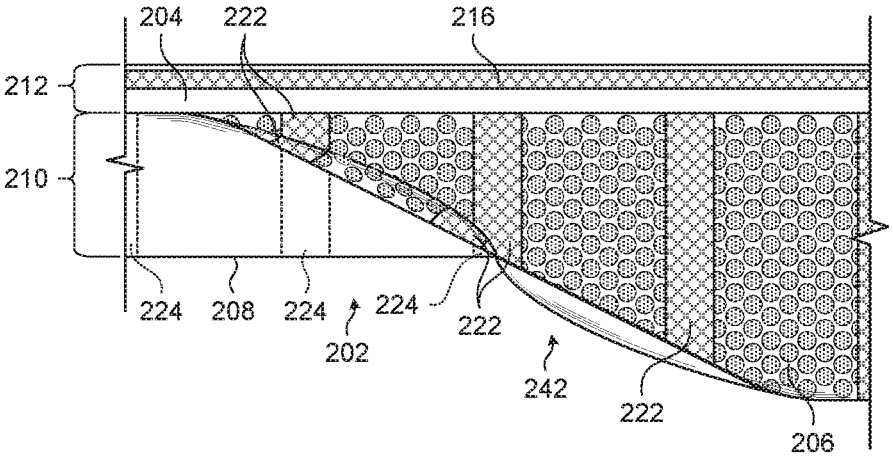
FIGS. 5A and 5B depict front and bottom views of an embodiment of a folding process of the laminated web material that is shown in FIG. 2, in accordance with the embodiments disclosed herein.
Figure 5B:
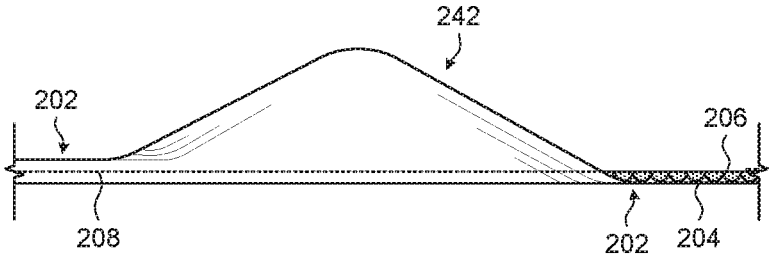

In the depicted embodiment, the fold 208 is an off-center fold in the laminated web material 202. The off-centered fold 208 defines a short side of the laminated web material 202 and a long side of the laminated web material 202. In FIG. 5A, the short side of the laminated web material 202 is located in front of the long side of the laminated web material 202. The laminated web material 202 forms a pocket 210 and a flap 212. The pocket 210 is formed from the short side of the laminated web material 202 and a portion of the long side of the laminated web material 202. The flap 212 is formed from a portion of the long side of the laminated web material 202 that extends beyond the pocket 210. In the depicted embodiment, the cushioning web 206 is laminated to the portion of the shell web 204 that is located in the pocket and the portion of the shell web 204 in the flap 212 is not laminated to the cushioning web 206. In the depicted embodiment, the flap 212 includes an adhesive strip 216 that is usable to close the flap 212. In the depicted embodiment, the adhesive strip 216 is at a location that is further away from the fold 208 than the short side of the laminated web material 202 extends from the fold 208.

Figure 6A:
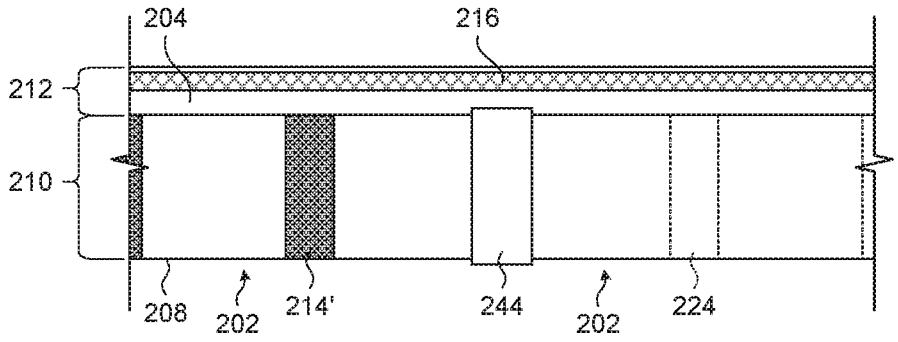
FIGS. 6A and 6B depict front and bottom views of an instance of the interaction of the crimping rollers and the laminated web material that are shown in FIG. 2, in accordance with the embodiments disclosed herein.
Figure 6B:
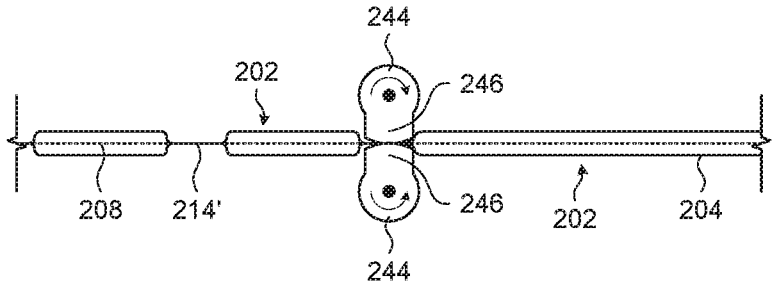
Figure 6C:
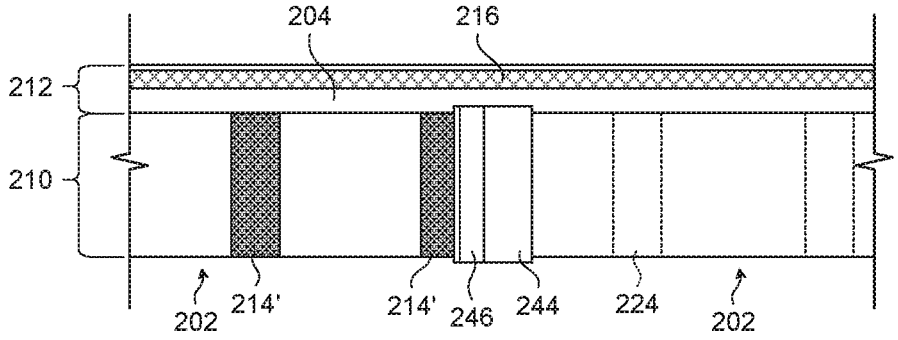
FIGS. 6C and 6D depict front and bottom views of another instance of the interaction of the crimping rollers and the laminated web material that are shown in FIG. 2, in accordance with the embodiments disclosed herein.
Figure 6D:
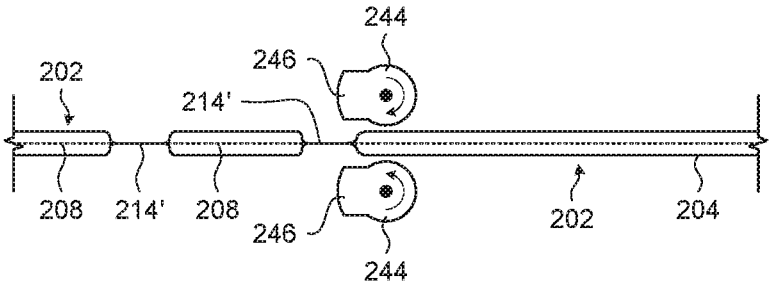

Referring back to FIG. 2, the system 230 includes crimping rollers 244. The laminated web material 202 is fed until it reaches the crimping rollers 244. The crimping rollers 244 and the laminated web material 202 are further depicted in front and bottom views of one instance shown in FIGS. 6A and 6B in front and bottom views of another instance shown in FIGS. 6C and 6D. Each of the crimping rollers 244 includes a crimping extension 246. The crimping extensions 246 extend further away from the rotational axis of the crimping rollers 244 than other portions of the crimping rollers 244 extend from the rotational axis. The crimping rollers 244 rotate as the laminated web material 202 is fed linearly. The crimping rollers 244 are arranged so that the crimping extensions 246 periodically contact the laminated web material 202 as the crimping rollers 244 rotate to form crimped areas 214'. More specifically, in the instance depicted in FIGS. 6A and 6B, the crimping extensions 246 extended toward each other to form one of the crimped areas 214'. The crimping rollers 244 continue to rotate and the laminated web material 202 is fed while the crimping rollers 244 are not in contact with the laminated web material 202, as shown in FIGS. 6C and 6D. In this way, the crimped areas 214' are longitudinally-spaced from each other in the laminated web material 202.

In the depicted embodiment, the crimped areas 214' are formed at the locations 224 of the transverse seams where the crimped adhesive 222 is located. In some embodiments, the rotational speed of the crimping rollers 244 and/or the linear speed of the laminated web material 202 are controlled in order to control locations of the crimped areas 214' in the laminated web material 202. In some embodiments, the rotational speed of the crimping rollers 244 is controlled so that a linear speed of the ends of the crimping extensions 246 is substantially similar to a linear speed of the laminated web material 202 when the crimping extensions 246 come into contact with the laminated web material 202. In the depicted embodiment, the ends of the crimping extensions 246 are convex. In some cases, the convex ends enable the crimping extensions 246 to remain close to each other as they are rotated through the position depicted in the instance shown in FIGS. 6A and 6B. In some embodiments, the crimping rollers 244 are located in an interference fit when each of the crimping extensions 246 extends toward another the other of the crimping rollers 244. In an interference fit, the distance between the two rotational axes of the crimping rollers 244 is less than the sum of the distance from the rotational axis of one of the crimping rollers 244 to the end of its crimping extension 246 and the distance from the rotational axis of the other of the crimping rollers 244 to the end of its crimping extension 246. In some embodiments, the interference is less than or equal to about 0.010 inches (0.25 mm). In some embodiments, the interference is about 0.004 inches (0.10 mm).

Referring back to FIG. 2, the system 230 further includes a cutting element 248. In some embodiments, the cutting element 248 includes one or more of a linear blade, a rotary blade, a heat element, or any other cutting mechanism. The cutting element 248 and the laminated web material 202 are further depicted in front and bottom views shown in FIGS. 7A and 7B. The cutting element 248 is configured to make transverse cuts in the laminated web material 202. In the depicted embodiment, the cutting element 248 is configured to make transverse cuts in the crimped areas 214' to form crimped sides 214 on either side of each cut. In some embodiments, the timing of the transverse cuts by the cutting element 248 is dependent on the rotation of the crimping rollers 244 so that the cutting element 248 makes a transverse cut once per rotation of the crimping rollers 244. As shown in the depicted embodiments, the cutting element 248 is configured to cut through the laminated web material 202, including the shell web 204 and the cushioning web 206, and the adhesive strip 216.

Figure 7A:
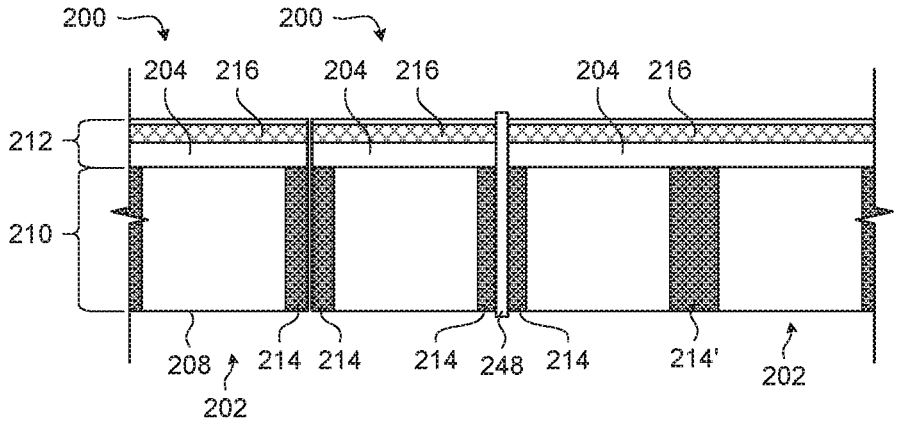
FIGS. 7A and 7B depict front and bottom views of an embodiment of a cutting element arranged to cut the laminated web material shown in FIG. 2, in accordance with the embodiments disclosed herein.
Figure 7B:
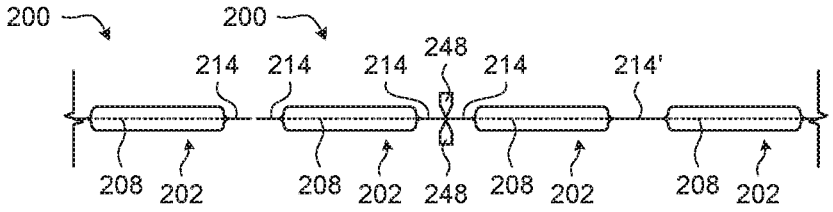
Figure 8A:
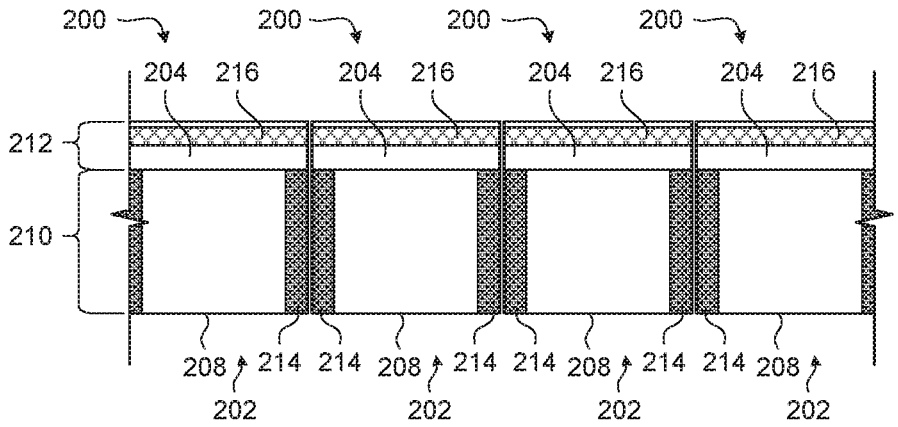
FIGS. 8A and 8B depict front and bottom views of an embodiment of cushioned envelopes formed from the laminated web material shown in FIG. 2, in accordance with the embodiments disclosed herein.
Figure 8B:
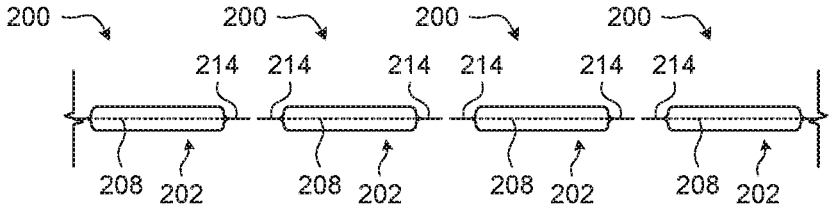

After subsequent transverse cuts are formed by the cutting element 248, the portion of the laminated web material 202 between two cuts forms a cushioned envelope 200. A number of cushioned envelopes 200 are shown in FIGS. 2, 7A, and 7B, and are further depicted in front and bottom views shown in FIGS. 8A and 8B. The cushioned envelope 200 is formed from the laminated web material 202, which includes the shell web 204 laminated to the cushioning web 206. The laminated web material 202 is folded about the off-center fold 208. In the embodiment shown in FIG. 8A, the short side is in front of the long side. The laminated web material 202 forms the pocket 210 and the flap 212. The pocket 210 of the cushioned envelope 200 includes crimped sides 214. In the depicted embodiment, the flap 212 includes an adhesive strip 216. As is discussed in greater detail below, the adhesive strip 216 can be used to close the cushioned envelope 200.

Depicted in FIGS. 9A to 9D are instances of a method of using the cushioned envelope 200 to packaging an object 260. The cushioned envelope 200 includes those features mentioned above with respect to FIGS. 8A and 8B. In the depicted embodiments, the object 260 is a tablet computing device. In other embodiments, the object 260 can be any item or collection of items capable of being placed inside the cushioned envelope 200.

Figure 9A:
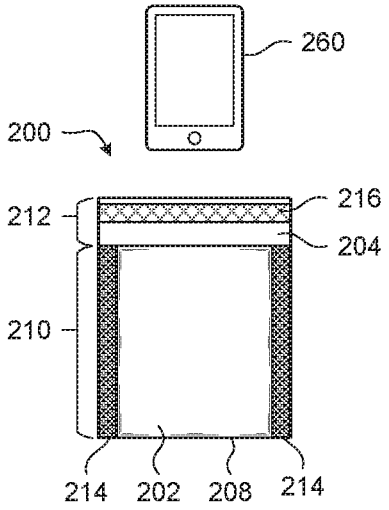
FIGS. 9A to 9D depict instances of a method of packaging an object using a cushioned envelope formed by the system and method shown in FIG. 2, in accordance with the embodiments disclosed herein.
Figure 9B:
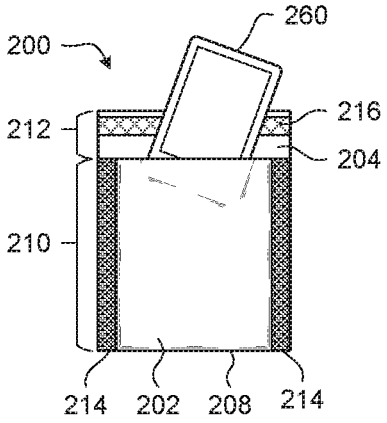
Figure 9C:
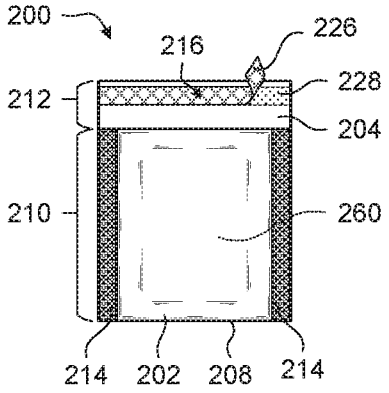
Figure 9D:
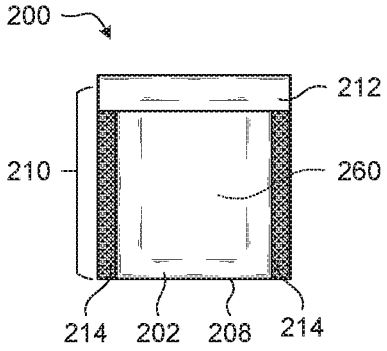

In FIG. 9A, the object 260 is located near the cushioned envelope 200. The flap 212 is open and the pocket 210 is unfilled. In FIG. 9B, the object 260 has been partially inserted into the pocket 210. In FIG. 9C, the object 260 has been fully inserted into the pocket 210. The adhesive strip 216 is also being prepared for use in closing the flap 212. In the depicted embodiment, the adhesive strip 216 includes a removable liner 226 that is located over a closure adhesive 228. As shown in FIG. 9C, the removable liner 226 is being removed from the closure adhesive 228. Once the removable liner 226 is completely removed from the closure adhesive 228, the flap 212 can be folded over and adhered to the front of the pocket 210. In FIG. 9D, the flap 212 is in a closed state with the flap 212 folded over and adhered to the front of the pocket 210. In other embodiments, the adhesive strip 216 has other forms, such as a press-and-seal adhesive that does not adhere to another surface until the press-and-seal adhesive is pressed against the other surface, a moistenable adhesive that does not adhere to another surface until it has been moistened, or any other form of adhesive.

Figure 10A:
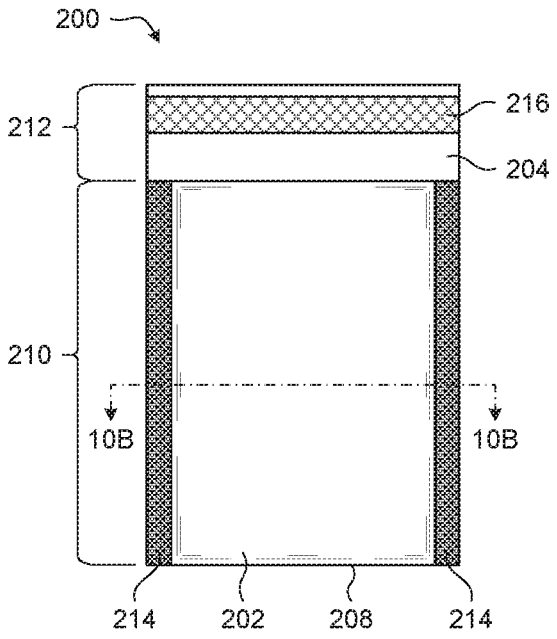
FIGS. 10A to 10C depict front, top cross-sectional, and partial detail views, respectively, of the cushioned envelope formed by the system and method shown in FIG. 2, including sides of the cushioned envelope that do not exhibit clam-shelling, in accordance with the embodiments disclosed herein.
Figure 10B:
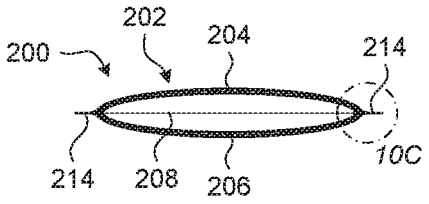
Figure 10C:
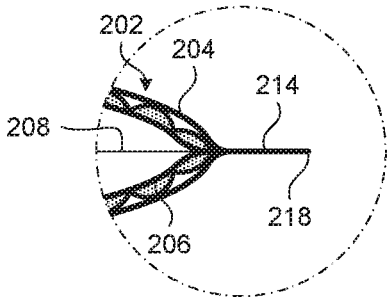

In some embodiments, the cushioned envelope 200 addresses the problem of the clam-shelling even if the shell web 204 is uncoated. FIGS. 10A to 10C depict front, top cross-sectional, and partial detail views, respectively, of the cushioned envelope 200 that does not exhibit clam-shelling along its side. In the depicted embodiment, the shell web 204 is made from a paper-based material that is uncoated (e.g., the shell web 204 is made from Kraft paper that does not have a polymer-based coating).

The crimped sides 214 have been formed from the crimping of a number of layers. More particularly, as described above, the laminated web material 202 is formed from a layer of the shell web 204, a layer of the laminating adhesive 220, and a layer of the cushioning web 206. Transverse seams of the crimping adhesive 222 are then applied to the cushioning web 206 of the laminated web material 202. Then, the laminated web material 202 is folded so that the transverse seams of the crimping adhesive 222 are folded in on themselves. As a result, the cross-section of the locations 224 of the seams includes one layer of the shell web 204, one layer of the laminating adhesive 220, one layer of the cushioning web 206, two layers of the crimping adhesive 222, another layer of the cushioning web 206, another layer of the laminating adhesive 220, and another layer of the shell web 204. The locations 224 of the seams are then crimped to form crimped areas 214' that are then cut to form the crimped sides 214.

In the depicted embodiment, ends 218 of the crimped sides 214 do not exhibit clam-shelling. In some embodiments, the ends 218 of the crimped sides 214 are held together by one or both of the laminating adhesive 220 or the crimping adhesive 222. In some cases, the strength of the seam at the crimped sides 214 is due to one or more of the formulation of the laminating adhesive 220, the temperature at which the laminating adhesive 220 is applied to the shell web 204 and/or the cushioning web 206, the formulation of the crimping adhesive 222, the temperature at which the crimping adhesive 222 is applied to the laminated web material, the force with which the crimping rollers 244 form the crimped areas 214', the temperature at which the crimping rollers 244 form the crimped areas 214', or the temperature at which the cutting element 248 cuts the crimped areas 214' to form the crimped sides 214. In some embodiments, the strength of the seam is greater than or equal to about 3.5 pounds per inch (0.63 kilograms per centimeter) of the seam. In some embodiments, the strength of the seam is greater than or equal to about 4.5 pounds per inch (0.80 kilograms per centimeter) of the seam.

One benefit of the system 230 and the method depicted in FIG. 2 is the speed with which the cushioned envelopes 200 can be created. In some embodiments, the system 230 and the method depicted in FIG. 2 are capable of producing the cushioned envelopes 200 at a rate of equal to or greater than 100 of the cushioned envelopes 200 per minute. In some embodiments, the system 230 and the method depicted in FIG. 2 are capable of producing the cushioned envelopes 200 at a rate of equal to or greater than 700 or 1000 of the cushioned envelopes 200 per minute. In some embodiments, the system 230 and the method depicted in FIG. 2 are capable of producing the cushioned envelopes 200 at a rate of equal to or greater than 150 of the cushioned envelopes 200 per minute. The rate at which the system 230 and the method depicted in FIG. 2 can produce the cushioned envelopes 200 may be greater than a rate at which the cushioned envelope 100 can be produced. As noted above, the cushioned envelope 100 can be made in a process that requires the laminated web material 102 to be halted repeatedly as it is fed. Such repeated halting of the laminated web material 102 slows the process of creating the cushioned envelopes 100. In contrast, the crimping rollers 244 are able to form the crimped areas 214' without halting the laminated web material 202.

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. A method of forming a cushioned envelope, the method comprising:

feeding a laminated web material comprising a cushioning web a shell web, wherein each of the cushioning web and the shell web includes an inner side and an outer side, wherein the outer side of the cushioning web is laminated to the inner side of the shell web;

applying a crimping adhesive to a first transverse seam of the inner side of the cushioning web and to a second transverse seam of the inner side of the cushioning web;

folding the laminated web material so that the first transverse seam on the inner side of the cushioning web is folded in on itself and the second transverse seam on the inner side of the cushioning web is folded in on itself;

after folding the laminated web material, crimping the laminated web material at the first transverse seam and at the second transverse seam, wherein crimping the laminated web material comprises rotating crimping rollers that comprise crimping extensions, wherein the crimping extensions extend further away from a rotational axis of the crimping rollers than other portions of the crimping rollers, and wherein the crimping rollers are arranged so that the crimping extensions pinch the laminated web material across a transverse length of the first and second transverse seams; and after crimping the laminated web material, cutting the laminated web material at a location in the first transverse seam and at a location in the second transverse seam.

2. The method of claim 1, further comprising:

forming the laminated web material, wherein the forming comprises:

applying a laminating adhesive to at least one of the inner side of the shell web or the outer side of the cushioning web, and pressing together the shell web and the cushioning web.

3. The method of claim 2, wherein the cushioning web includes a sheet of inflated cells.

4. The method of claim 3, further comprising:

before forming the laminated web material, inflating the sheet of inflated cells.

5. The method of claim 2, wherein the crimping adhesive and the laminating adhesive have different formulations.

6. The method of claim 1, wherein the crimping rollers are arranged so that the crimping extensions are in an interference fit when each of the crimping extensions extends toward another of the crimping rollers.

7. The method of claim 6, wherein at least one of the ends of the crimping extensions is convex.

8. The method of claim 1, wherein rotating the crimping rollers comprises controlling a rotational speed of the crimping rollers so that a linear speed of ends of the crimping extensions is substantially similar to a linear speed of the laminated web material.

9. The method of claim 1, wherein each of the first transverse seam and the second transverse seam has a seam strength that is greater than or equal to about 3.5 pounds per inch of seam.

10. The method of claim 1, wherein the method is performed repeatedly to cause formation of the cushioned envelope at a rate of at least 700 cushioned envelopes per minute.

11. A method of forming a cushioned envelope, the method comprising:

feeding a laminated web material comprising a cushioning web a shell web, wherein each of the cushioning web and the shell web includes an inner side and an outer side, wherein the outer side of the cushioning web is laminated to the inner side of the shell web, wherein the cushioning web comprises an air cellular material having a series of transverse rows of inflated cells;

deflating at least one of the transverse rows of inflated cells to form at least one transverse row of deflated cells;

after deflating the at least one of the transverse rows of inflated cells, applying a crimping adhesive to a first transverse seam of the inner side of the cushioning web and to a second transverse seam of the inner side of the cushioning web, wherein the crimping adhesive is applied to the at least one transverse row of deflated cells;

folding the laminated web material so that the first transverse seam on the inner side of the cushioning web is folded in on itself and the second transverse seam on the inner side of the cushioning web is folded in on itself;

after folding the laminated web material, crimping the laminated web material at the first transverse seam and at the second transverse seam; and after crimping the laminated web material, cutting the laminated web material at a location in the first transverse seam and at a location in the second transverse seam.

12. The method of claim 11, wherein the deflating includes peeling back a first layer of the air cellular material to expose a second layer of the air cellular material, and wherein the crimping adhesive is applied to the second layer of the deflated at least one of the transverse rows of inflatable cells.

13. A cushioned envelope, comprising:

a laminated web material including a cushioning web and a shell web, wherein each of the cushioning web and the shell web includes an inner side and an outer side, wherein the outer side of the cushioning web is laminated to the inner side of the shell web, wherein the cushioning web comprises an air cellular material having transverse rows of cells that includes rows of inflated cells, a first row of deflated cells and a second row of deflated cells;

first and second transverse seams on the inner side of the cushioning web, wherein the first transverse seam includes the first row of deflated cells and the second transverse seam includes the second row of deflated cells; and a crimping adhesive applied to the first and second transverse seams on at least the first and second rows of deflated cells;

wherein the laminated web material is folded so that the first transverse seam on the inner side of the cushioning web is folded in on itself and the second transverse seam on the inner side of the cushioning web is folded in on itself; and wherein the folded laminated web material is crimped at a location in the first transverse seam and at a location in the second transverse seam so that the crimped locations in the first and second transverse seams form sides of the cushioned envelope.

14. The cushioned envelope of claim 13, wherein a laminating adhesive applied to at least one of the inner side of the shell web or the outer side of the cushioning web adheres the shell web to the cushioning web.

15. The cushioned envelope of claim 13, wherein the laminated web material is folded at an off-center fold in the laminated web material, and wherein the off-center fold defines a short side of the laminated web material and a long side of the laminated web material.

16. The cushioned envelope of claim 15, wherein the long side comprises an adhesive strip.

17. The cushioned envelope of claim 16, wherein the short side extends a first distance away from the off-center fold, wherein the adhesive strip is located on the long side at a location that is a second distance away from the off-center fold, and wherein first distance is less than the second distance.

18. The cushioned envelope of claim 13, wherein the shell web comprises a paper-based material, and wherein the outer side of the shell web is uncoated.

19. The cushioned envelope of claim 13, wherein each of the first transverse seam and the second transverse seam has a seam strength that is greater than or equal to about 4.5 pounds per inch of seam.

* * * * *